US010123616B2

(12) United States Patent
Chen

(10) Patent No.: US 10,123,616 B2
(45) Date of Patent: Nov. 13, 2018

(54) TALL CABINET QUICK RELEASE STRUCTURE

(71) Applicant: GSLIDE CORPORATION, New Taipei (TW)

(72) Inventor: Yung-Liang Chen, Taipei Shien (TW)

(73) Assignee: GSLIDE CORPORATION, New Taipei (TW)

( * ) Notice: Subject to any disclaimer, the term of this patent is extended or adjusted under 35 U.S.C. 154(b) by 113 days.

(21) Appl. No.: 15/435,994

(22) Filed: Feb. 17, 2017

(65) Prior Publication Data

US 2017/0238709 A1 Aug. 24, 2017

(30) Foreign Application Priority Data

Feb. 22, 2016 (TW) ..... 105105115 A

(51) Int. Cl.

| | |
|---|---|
| ***A47B 88/00*** | (2017.01) |
| ***A47B 88/427*** | (2017.01) |
| ***A47B 88/42*** | (2017.01) |
| ***A47B 88/969*** | (2017.01) |
| ***A47B 88/483*** | (2017.01) |

(52) U.S. Cl.

CPC ..... *A47B 88/427* (2017.01); *A47B 88/42* (2017.01); *A47B 88/483* (2017.01); *A47B 88/969* (2017.01); *A47B 2088/4274* (2017.01); *A47B 2088/4278* (2017.01); *A47B 2210/0056* (2013.01); *A47B 2210/0062* (2013.01)

(58) Field of Classification Search

CPC ..... A47B 88/42; A47B 88/423; A47B 88/427; A47B 2088/4235; A47B 2088/4272; A47B 2088/4274; A47B 2088/4276; A47B 2088/4278; A47B 2210/0062

See application file for complete search history.

(56) References Cited

U.S. PATENT DOCUMENTS

| | | | | |
|---|---|---|---|---|
| 6,231,138 | B1 * | 5/2001 | Janson | A47B 53/02 312/201 |
| 7,971,944 | B2 * | 7/2011 | Sagel | A47B 88/42 312/270.3 |
| 8,056,994 | B2 * | 11/2011 | Chen | A47B 88/427 312/334.14 |
| 8,854,769 | B1 * | 10/2014 | Liang | A47B 88/427 360/125.51 |
| 2008/0111457 | A1 * | 5/2008 | Ji | A47B 88/493 312/334.44 |

(Continued)

*Primary Examiner* — Matthew W Ing
(74) *Attorney, Agent, or Firm* — Cook Alex Ltd.

(57) ABSTRACT

A cabinet quick release structure includes an upper sliding rail assembly, a bracket having front and rear positioning blocks, a tray, left and right latch devices and a lower sliding rail assembly arranged so that when dismounting a wooden cabinet from a cabinet housing, a user pulls a latch block of the front positioning block, and then pushes an inner sliding rail of the upper sliding rail assembly backward to move front and rear positioning rods of an inner sliding rail respectively out the front and rear positioning blocks, and then disengages the left and right latch devices from a bottom locating frame of the lower sliding rail assembly. When mounting the wooden cabinet, the front positioning rod of the inner sliding rail is locked by the latch block while the rear positioning rod is located in the rear positioning block and the latch devices engage the bottom locating frame.

20 Claims, 19 Drawing Sheets

(56) References Cited

U.S. PATENT DOCUMENTS

| | | | | |
|---|---|---|---|---|
| 2015/0147008 | A1* | 5/2015 | McGregor | A47B 88/407<br>384/22 |
| 2016/0128476 | A1* | 5/2016 | Ng | A47B 88/16<br>312/333 |
| 2016/0198855 | A1* | 7/2016 | Liang | A47B 88/427<br>248/241 |
| 2016/0345731 | A1* | 12/2016 | Youngs | A47B 96/04 |
| 2017/0095080 | A1* | 4/2017 | Chen | A47B 88/427 |
| 2017/0204557 | A1* | 7/2017 | Bunch | D06F 79/02 |

* cited by examiner

TALL CABINET QUICK RELEASE STRUCTURE

BACKGROUND OF THE INVENTION

Field of the Invention

The present invention relates to wooden cabinet mountings and more particularly, to a tall cabinet quick release structure, which facilitates mounting a wooden cabinet in a cabinet housing and dismounting of the wooden cabinet from the cabinet housing.

Description of the Related Art

A tall cabinet assembly may comprise a cabinet housing and a wooden cabinet mounted in the cabinet housing. By means of the arrangement of an upper sliding rail assembly and a lower sliding rail assembly, the wooden cabinet may be conveniently moved in and out of the cabinet housing between a retracted position and an extended open position. However, because the opposing top and bottom walls of the wooden cabinet are respectively affixed to the upper and lower sliding rail assemblies, it is inconvenient to mount and dismount the wooden cabinet from the cabinet housing. More particularly, the wooden cabinet is tall and heavy, and requires much effort to be moved in or out of the cabinet housing during the mounting or dismounting operation.

SUMMARY OF THE INVENTION

The present invention seeks to overcome disadvantages in the prior art. It is therefore the main object of the present invention to provide a tall cabinet quick release structure, which facilitates mounting of a wooden cabinet in a cabinet housing rapidly and in a dismountable manner.

It is another object of the present invention to provide a tall cabinet quick release structure, which allows mounting and dismounting of a wooden cabinet in a wooden cabinet housing in a releasable manner in a forward-backward direction smoothly, safely and with less effort.

It is still another object of the present invention to provide a tall cabinet quick release structure, which enables locating notches at a bearing surface of a tray of the wooden cabinet to be forced into engagement with respective stop plates of a lower sliding rail assembly in the cabinet housing, enhancing installation stability.

To achieve these and other objects of the present invention, a tall cabinet quick release structure comprises an upper sliding rail assembly that comprises an outer sliding rail affixed to a bottom surface of a top panel of a open-front cabinet housing and an inner sliding rail coupled to and axially movable in and out of the outer sliding rail and comprising a front positioning rod and a rear positioning rod respectively downwardly extended from a bottom wall thereof, a bracket affixed to a top surface of a wooden cabinet, a front positioning block affixed to the bracket and to the top surface of the wooden cabinet for releasably securing the front positioning rod of the inner sliding rail of the upper sliding rail assembly, a rear positioning block affixed to the bracket and to the top surface of the wooden cabinet and comprising a position-limiting groove extended in the sliding direction of the inner sliding rail of the upper sliding rail assembly for allowing the front positioning rod of the inner sliding rail of the upper sliding rail assembly to pass therethrough and for releasably locating the rear positioning rod of the inner sliding rail, a tray comprising a flat bearing surface, a plurality of through holes cut through the bearing surface and affixed to an opposing bottom surface of the wooden cabinet, an upright locating plate with multiple through holes located at an opposing rear side of the bearing surface and affixed to a bottom edge of a rear panel of the wooden cabinet, two side flanges respectively downwardly extended along opposing left and right sides of the bearing surface, at least one locating notch located at the rear side of the bearing surface and a plurality of through holes symmetrically located at a front side relative to the side flanges and affixed to the bottom surface of the wooden cabinet and left and right latch devices, left and right latch devices respectively mounted at two opposing left and right sides of the tray and respectively fastenable to opposing left and right sides of a lower sliding rail assembly, and the lower sliding rail assembly coupled with the tray for allowing the tray to slide back and forth thereon. The lower sliding rail assembly comprises a sliding rail holder affixed to an inner bottom surface of the cabinet housing, an inner bracket axially movable in and out of the sliding rail holder and a bottom locating frame affixed to a top side of the inner bracket above the sliding rail holder and movable with the inner bracket back and forth relative to the sliding rail holder. The bottom locating frame comprises at least one stop plate located on a top surface near a rear end thereof for engaging into the at least one locating notch at the bearing surface of the tray to stop the tray from backward displacement, and two retaining grooves respectively located on two opposite sidewalls for engagement of the left and right latch devices.

When dismounting the wooden cabinet, a user pulls the latch block of the front positioning block outward to move the front positioning rod out of the front positioning block, and then pushes the inner sliding rail backward to disengage the rear positioning rod from the accommodation chamber of the front positioning block and the position-limiting groove of the rear positioning block, and then presses the left and right latch devices to disengage the respective hook blocks from the left and right retaining grooves of the bottom locating frame of the lower sliding rail assembly and then pulls the wooden cabinet out of the open-front cabinet housing.

When mounting the wooden cabinet, the user enables the front positioning rod of the upper sliding rail assembly to be locked by the latch block of the front positioning block and the rear positioning rod to be secured in place by the position-limiting groove of the rear positioning block and at the same time, enables the hook blocks of the left and right latch devices to hook in the retaining grooves at the bottom locating frame of the lower sliding rail assembly.

DETAILED DESCRIPTION OF THE PREFERRED EMBODIMENT

Figure 1:
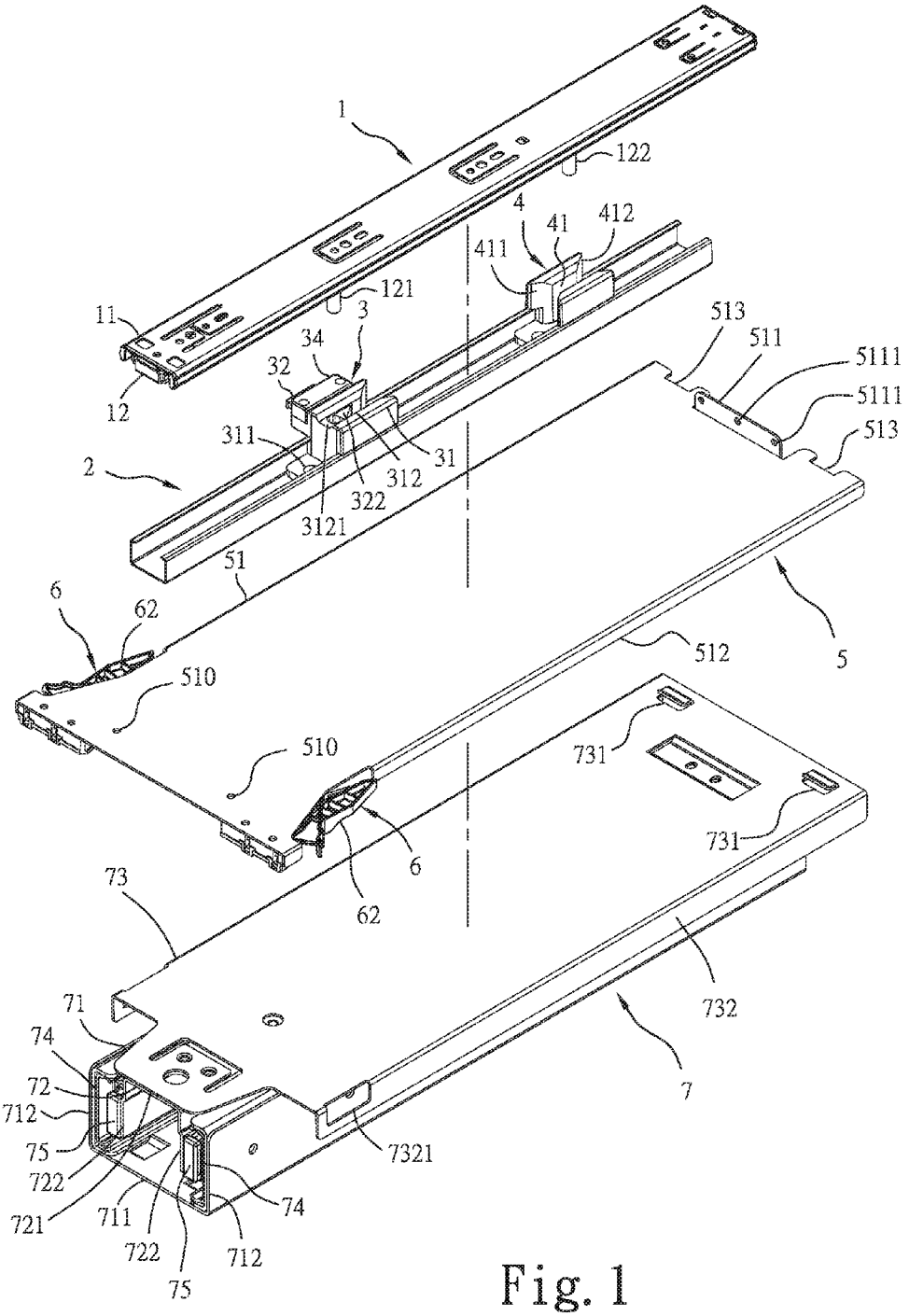
FIG. 1 is an exploded upper perspective view of an upper sliding rail assembly, a front positioning block, a rear positioning block, a bracket, a tray, left and right latch devices and a lower sliding rail assembly of a tall cabinet quick release structure in accordance with the present invention.
Figure 2:
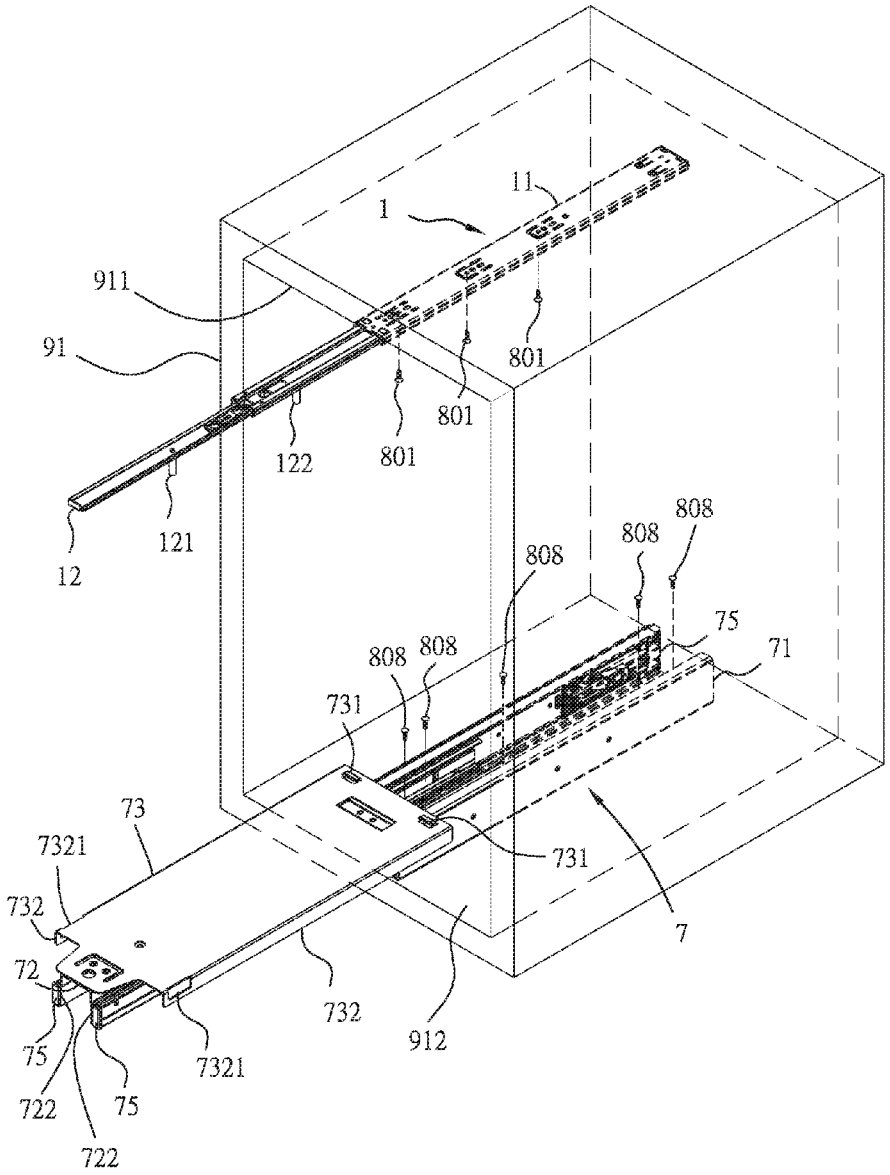
FIG. 2 is an upper perspective view illustrating the upper sliding rail assembly and the lower sliding rail assembly mounted in the cabinet housing.
Figure 12:
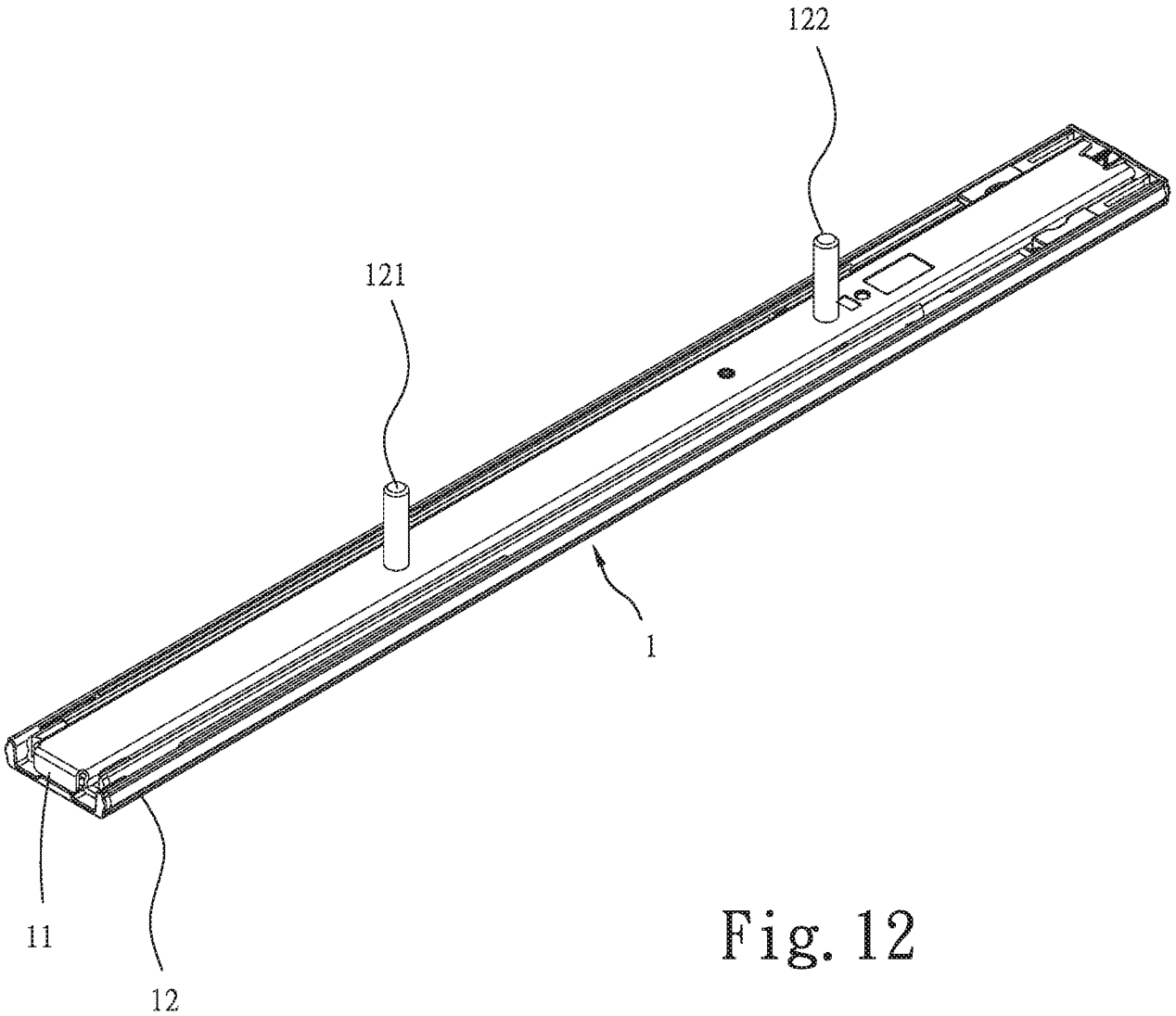
FIG. 12 is an enlarged lower perspective view of the upper sliding rail assembly.
Figure 13:
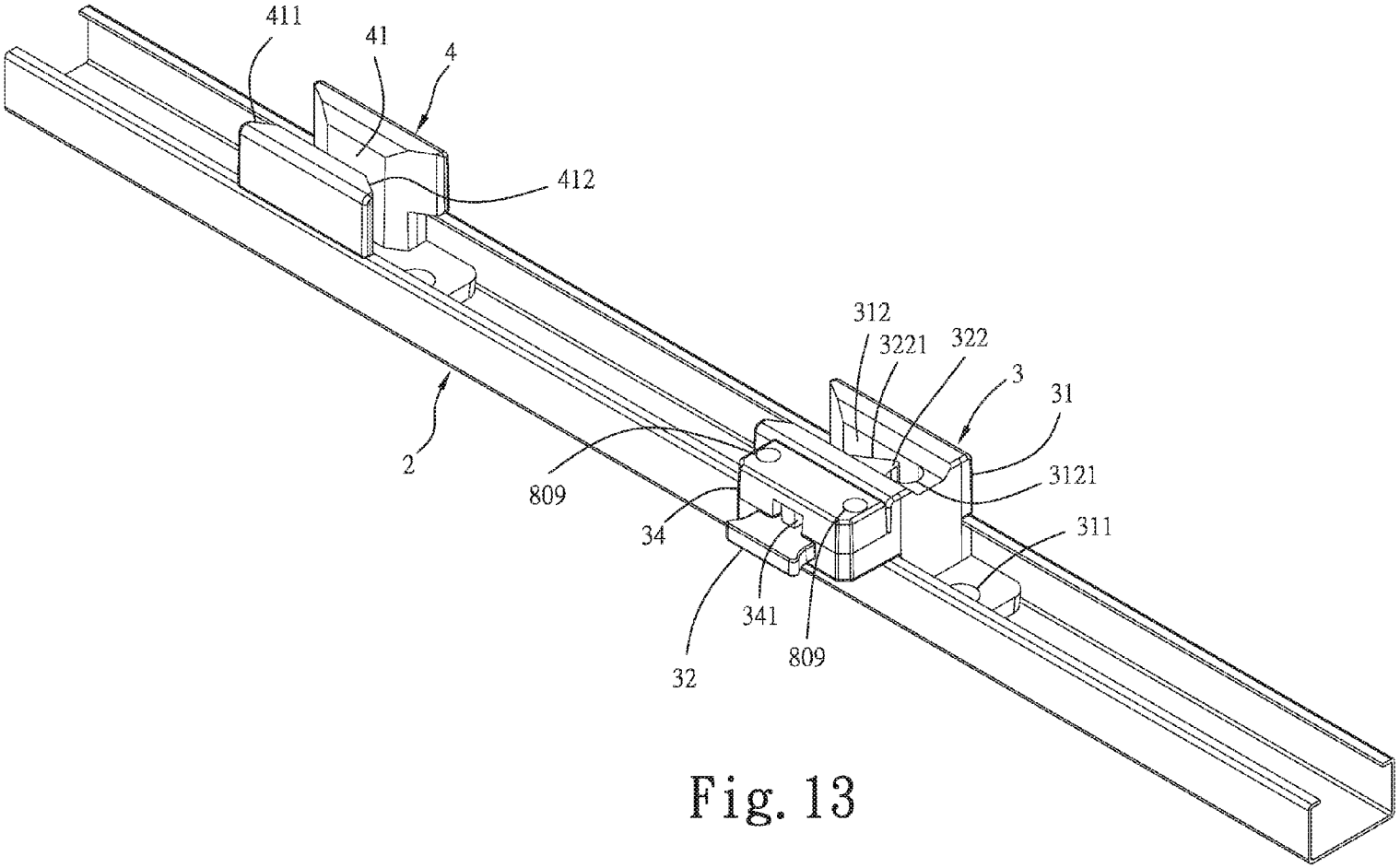
FIG. 13 is an enlarged upper perspective view of the front positioning block, the rear positioning block and the bracket.
Figure 14:
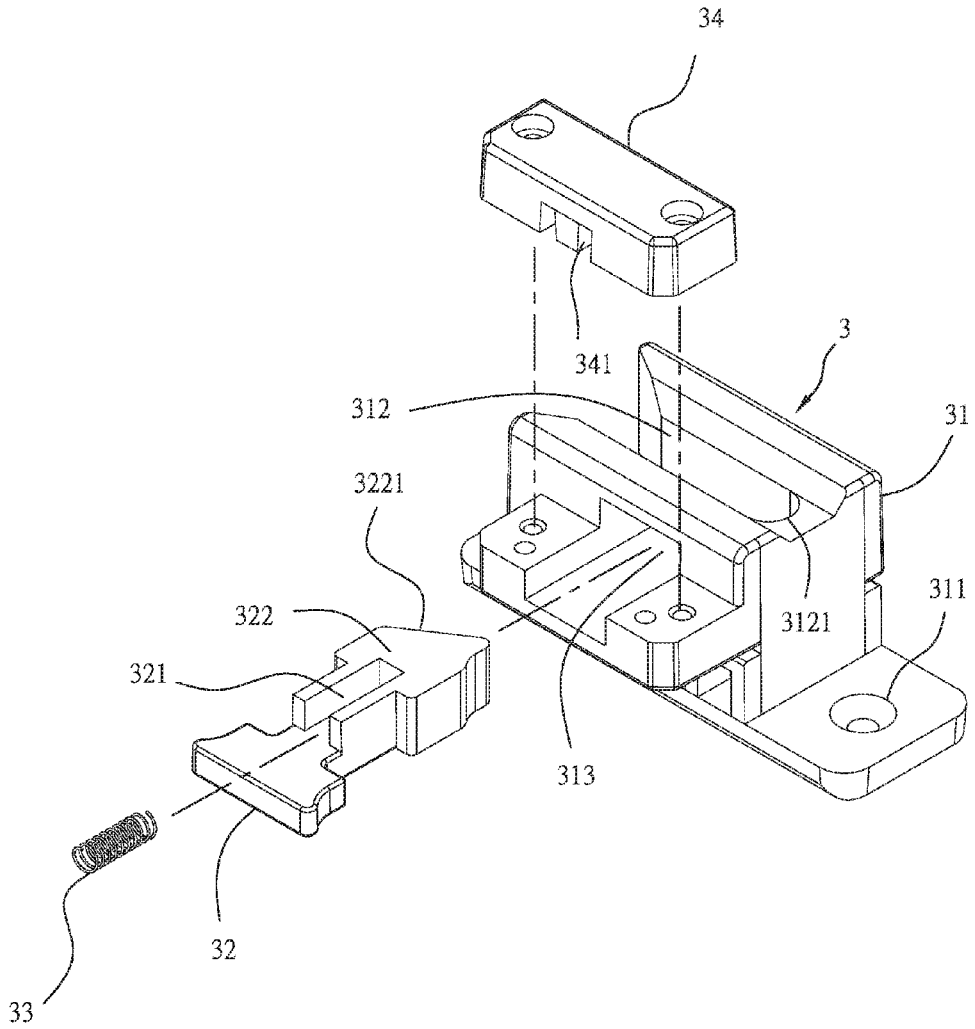
FIG. 14 is an enlarged upper perspective exploded view of the front positioning block.
Figure 15:
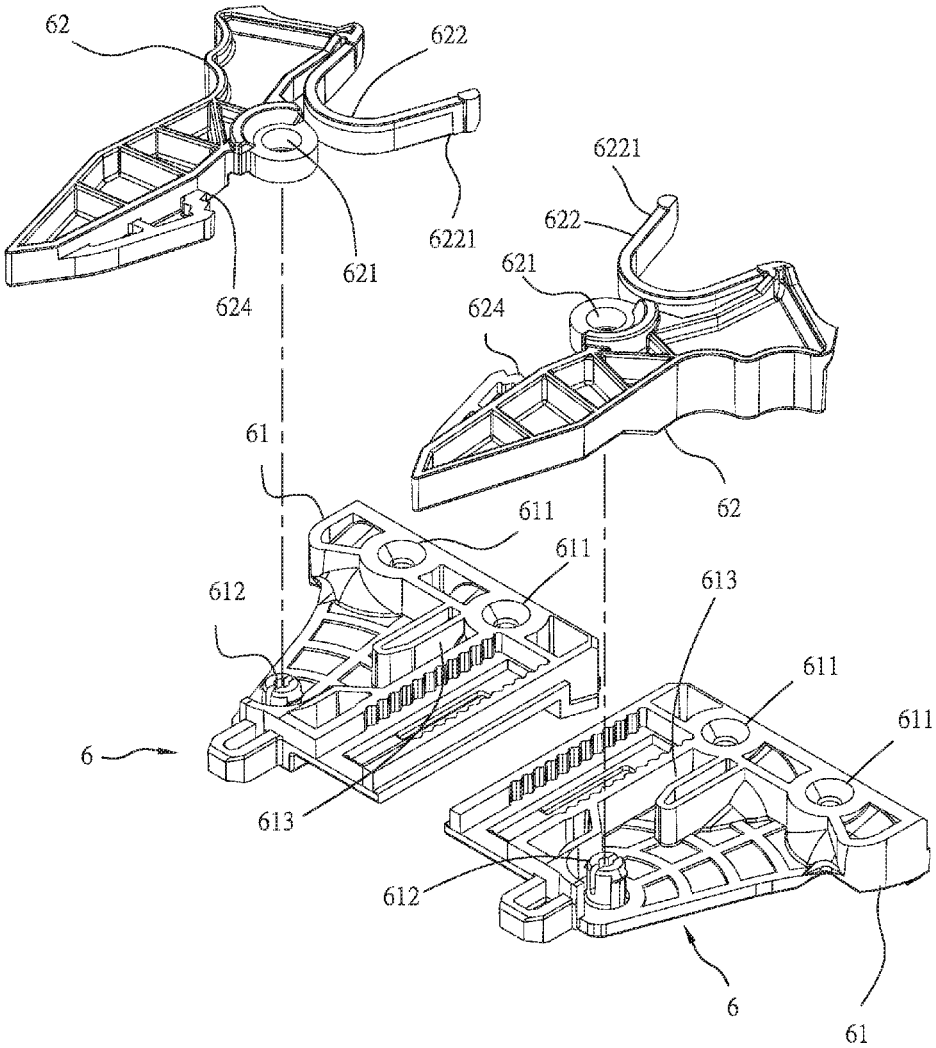
FIG. 15 is an enlarged upper perspective exploded view of the left and right latch devices.
Figure 16:
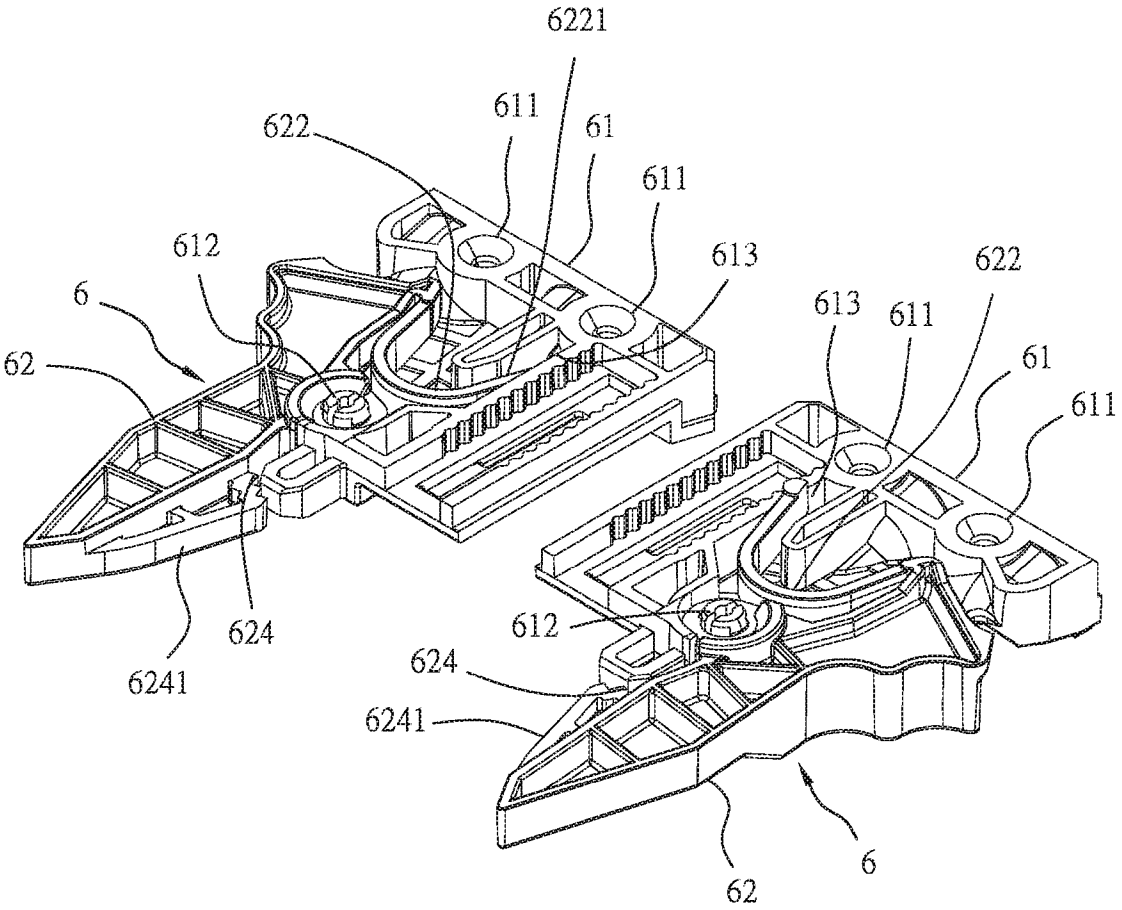
FIG. 16 is an enlarged upper perspective assembly view of the left and right latch devices.
Figure 17:
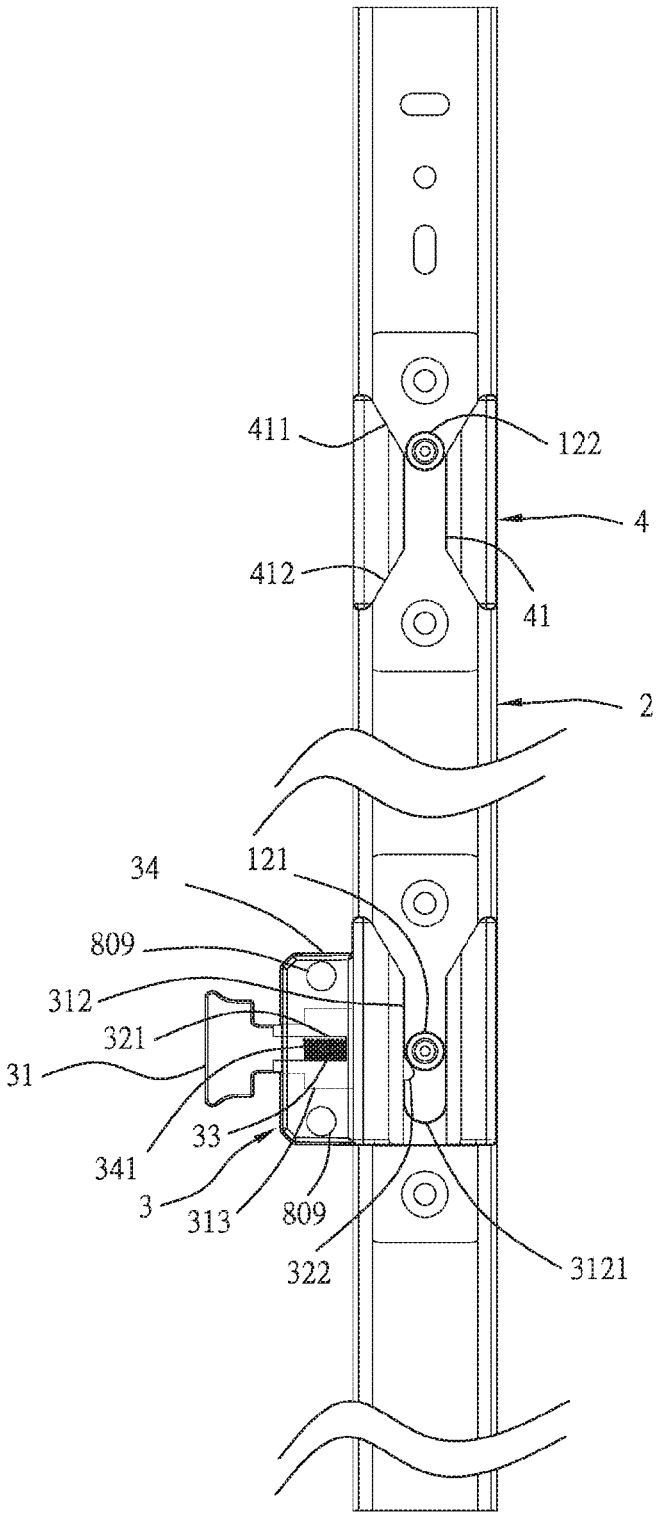
FIG. 17 is a schematic top plan view illustrating a disengaged status of the latch block of the front positioning block.
Figure 18:
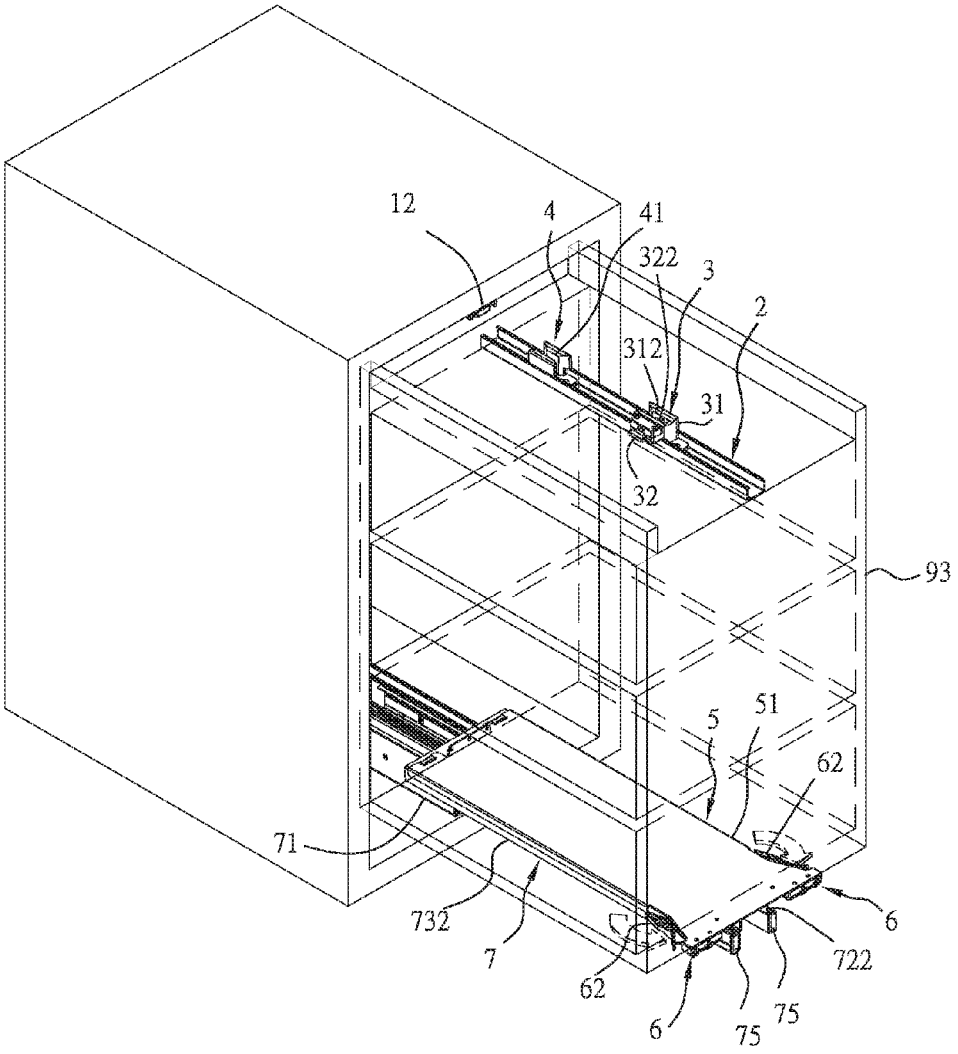
FIG. 18 is a schematic upper perspective view with arrows illustrating a pressed status of the left and right latch devices and the front and rear positioning rods of the upper sliding rail assembly disengaged from the front positioning block.
Figure 19:
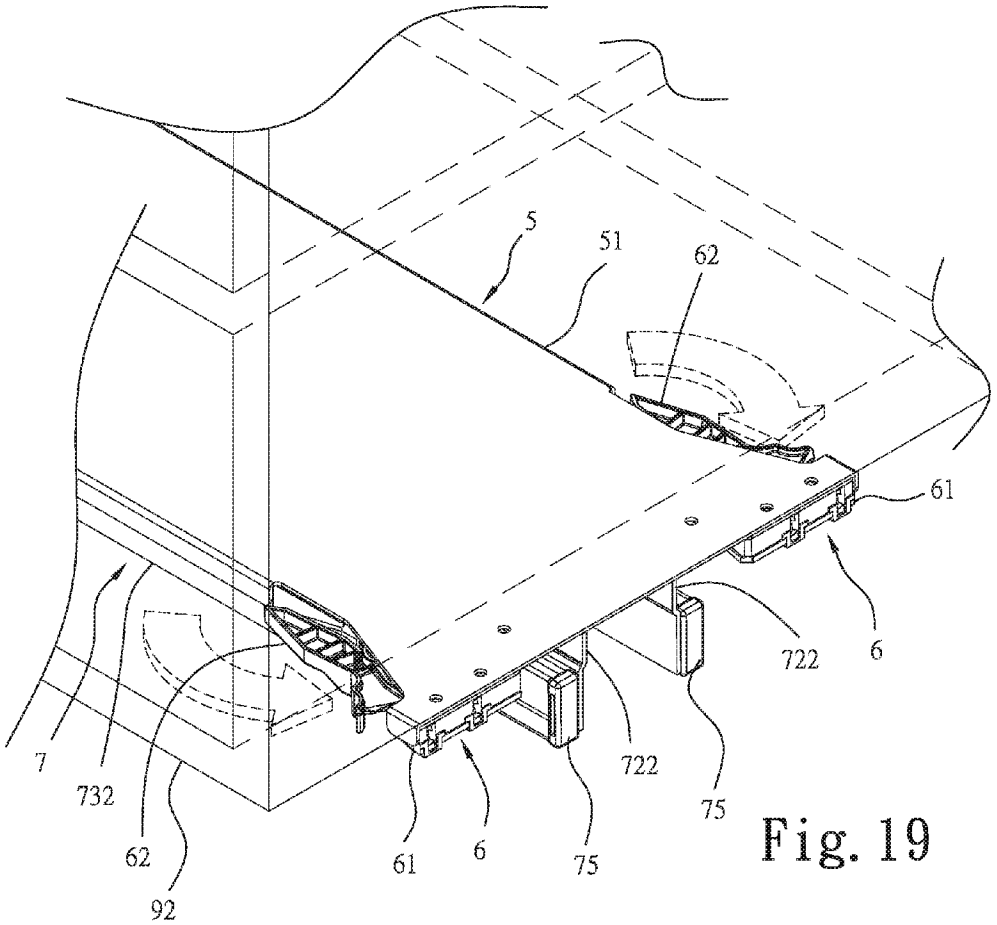
FIG. 19 is a schematic enlarged upper perspective view with arrows illustrating a pressed status of the left and right latch devices.

Referring to FIGS. 1-19, a tall cabinet quick release structure in accordance with the present invention is shown. The tall cabinet quick release structure includes an upper sliding rail assembly 1 (see FIGS. 1, 2 and 12), which comprises an outer sliding rail 11 affixed to a bottom surface 911 of a top panel of an open-front cabinet housing 91 by first fastening members 801 (see FIG. 2), and an inner sliding rail 12 coupled to and axially movable in and out of the outer sliding rail 11 and having a front positioning rod 121 and a rear positioning rod 122 respectively downwardly extended from a bottom wall thereof.

The tall cabinet quick release structure also includes a bracket 2 affixed to a top surface 921 of a wooden cabinet 92 by second fastening members 802 (see FIGS. 1 and 3), a front positioning block 3 affixed to the bracket 2 and the top surface 921 of the wooden cabinet 92 by third fastening members 803 and adapted for releasably securing the front positioning rod 121 of the inner sliding rail 12 of the upper sliding rail assembly 1. A rear positioning block 4 also is affixed to the bracket 2 and the top surface 921 of the wooden cabinet 92 by fourth fastening members 804 and has a position-limiting groove 41 extended in the sliding direction of the inner sliding rail 12 of the upper sliding rail assembly 1 (see FIGS. 1, 3, 10 and 13) and adapted for allowing the front positioning rod 121 of the inner sliding rail 12 of the upper sliding rail assembly 1 to pass therethrough and for releasably locating the rear positioning rod 122 of the inner sliding rail 12 to stop the rear positioning rod 122 from vibration or displacement (see FIG. 10).

Figure 3:
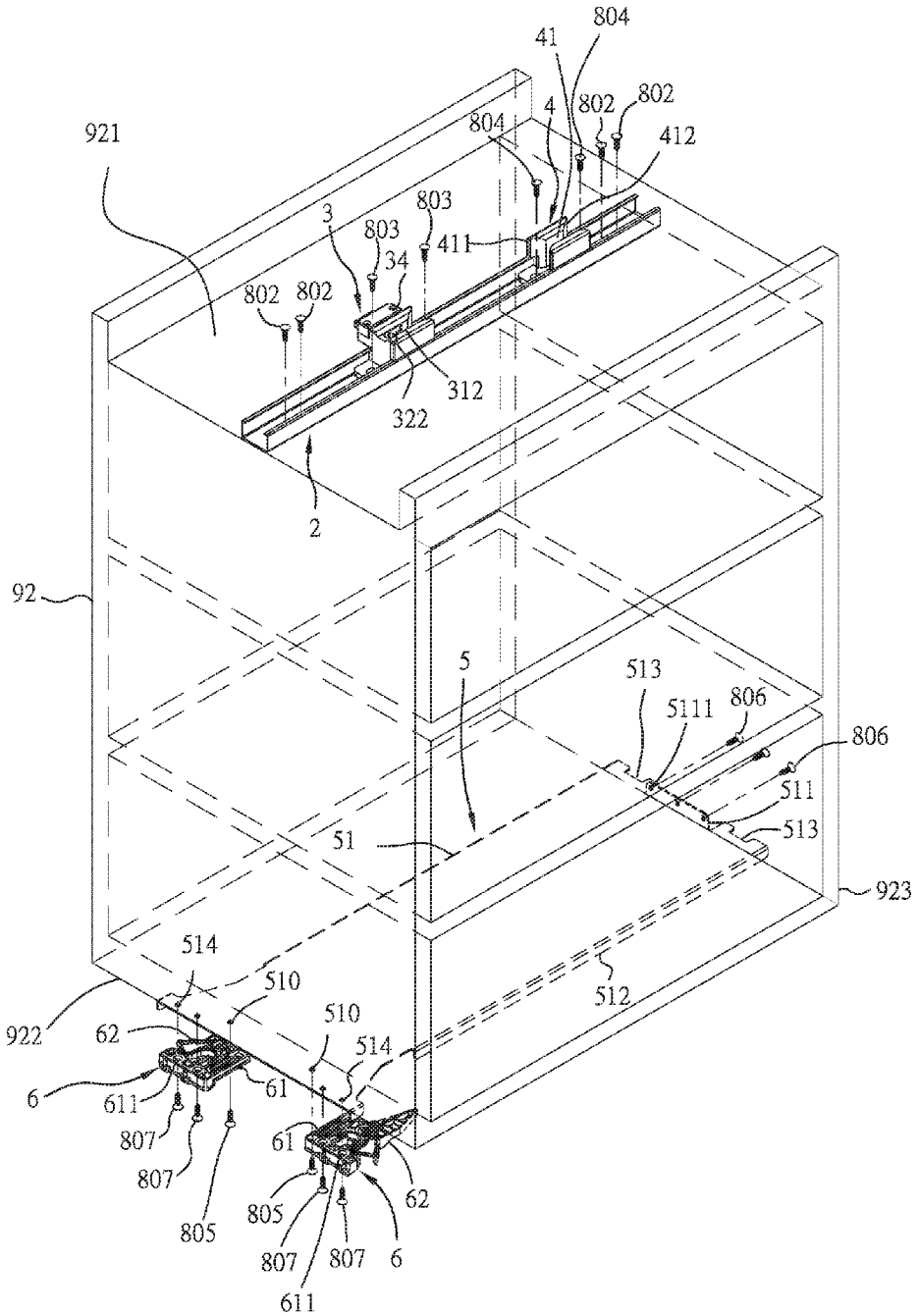
FIG. 3 is an upper perspective view illustrating the front positioning block, the rear positioning block, the bracket and the tray mounted in the wooden cabinet and the left and right latch devices in a disengaged status.
Figure 4:
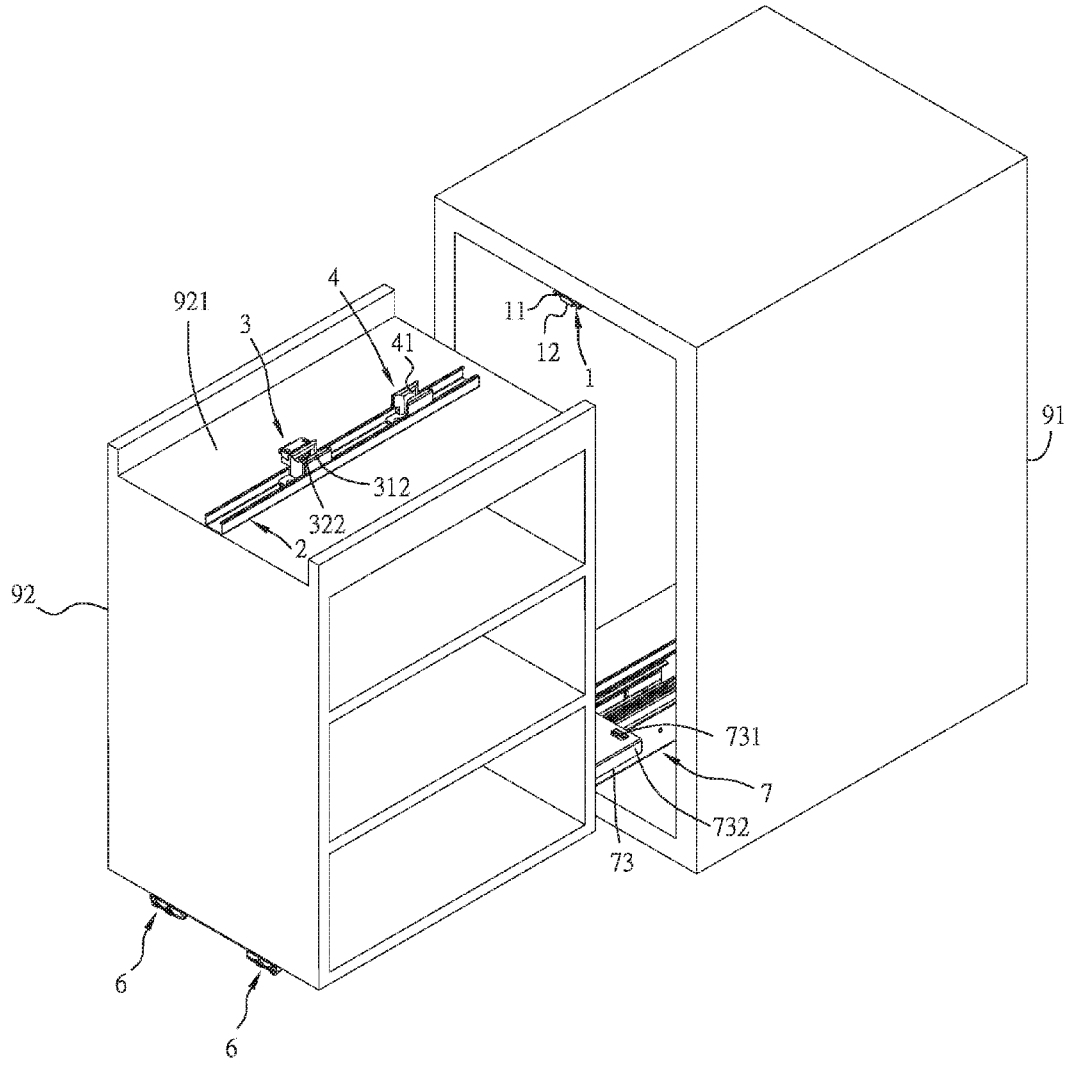
FIG. 4 is an upper perspective view illustrating the wooden cabinet mounted on the bottom locating frame of the lower sliding rail assembly of the cabinet housing and with the wooden cabinet extended outward of the cabinet housing.
Figure 5:
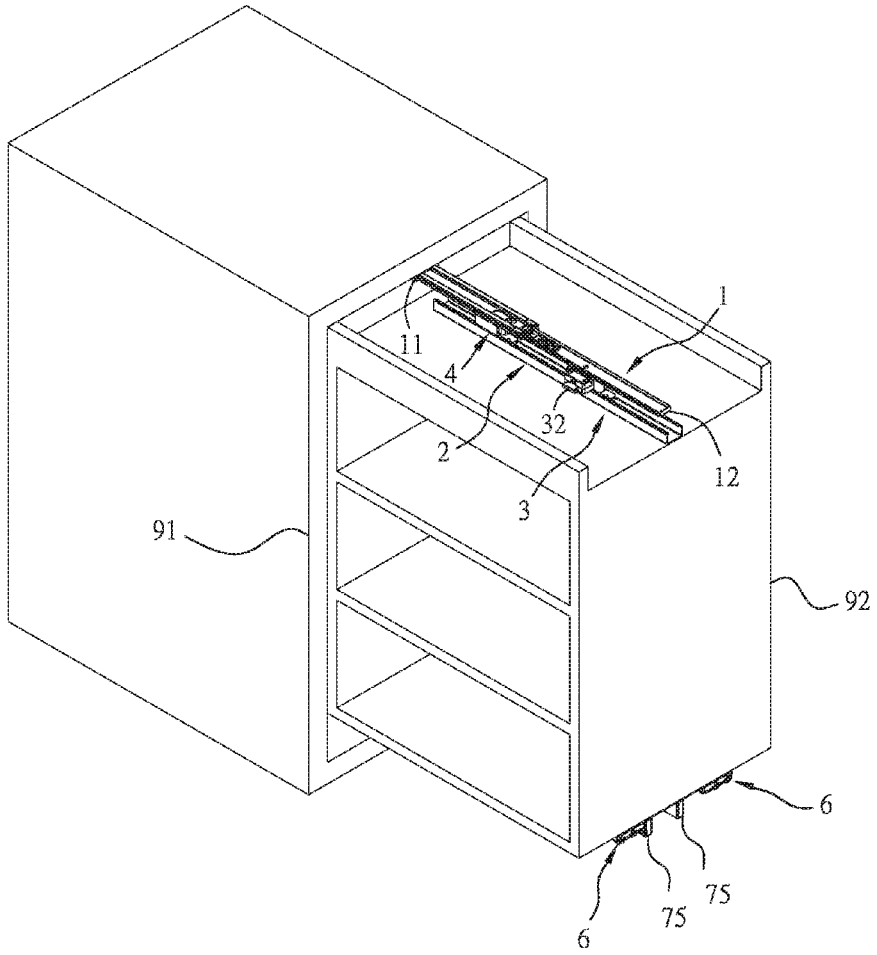
FIG. 5 corresponds to FIG. 4, illustrating the wooden cabinet partially positioned in the cabinet housing.
Figure 6:
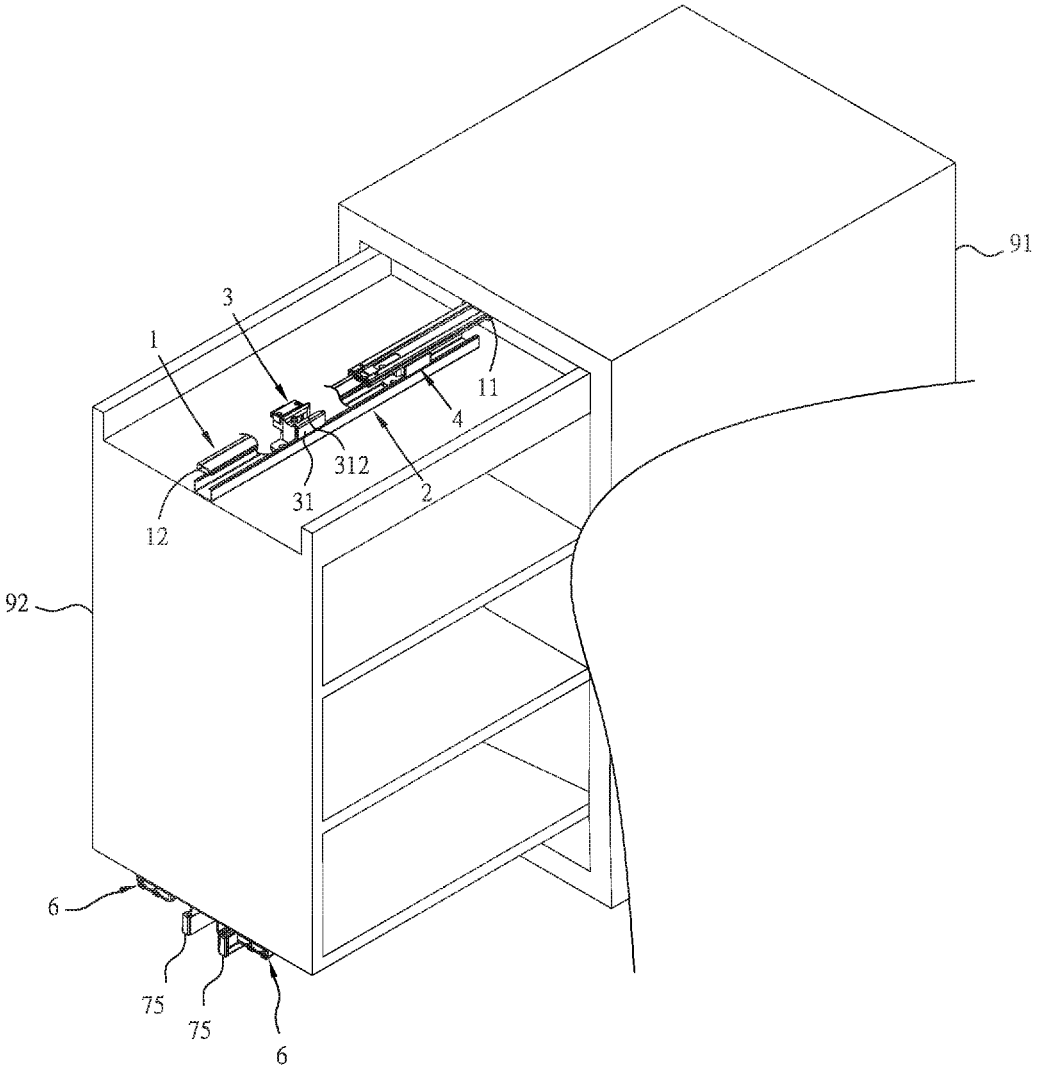
FIG. 6 corresponds to FIG. 5 when viewed from another angle.
Figure 7:
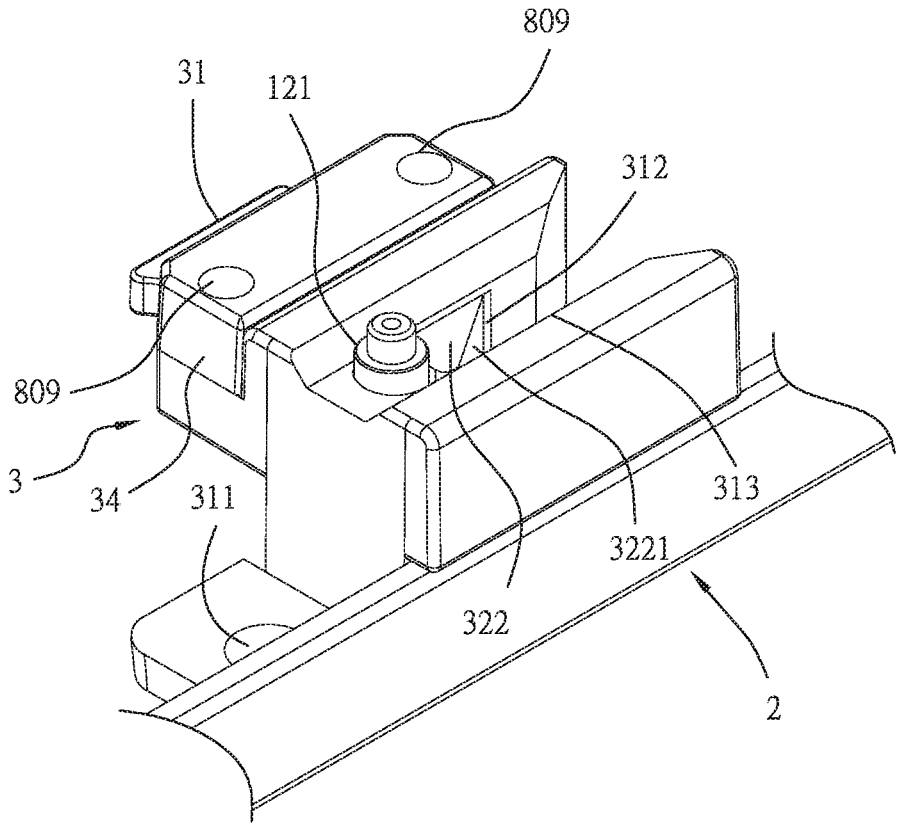
FIG. 7 is an enlarged view illustrating the structural design of the front positioning block.
Figure 8:
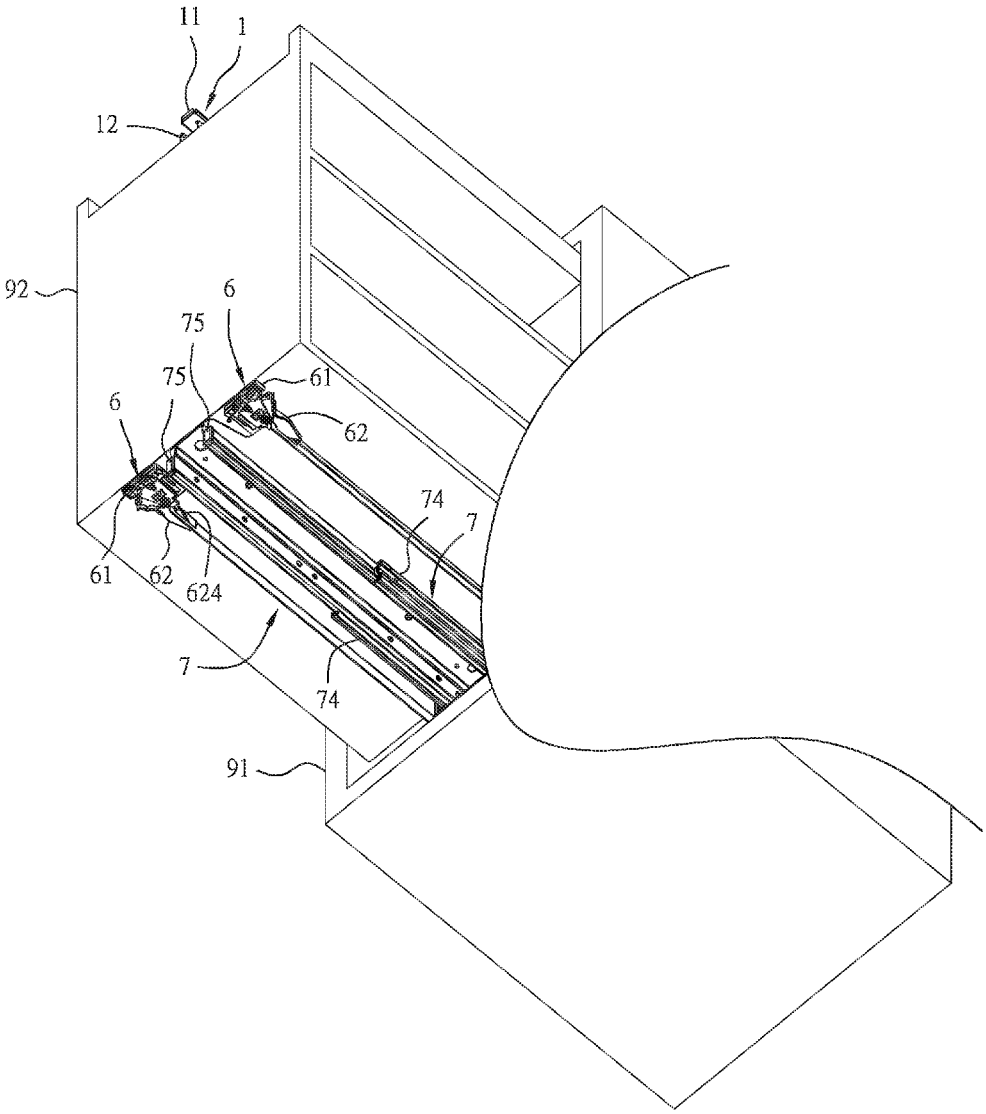
FIG. 8 is a lower perspective view of that corresponds to FIG. 6.
Figure 9:
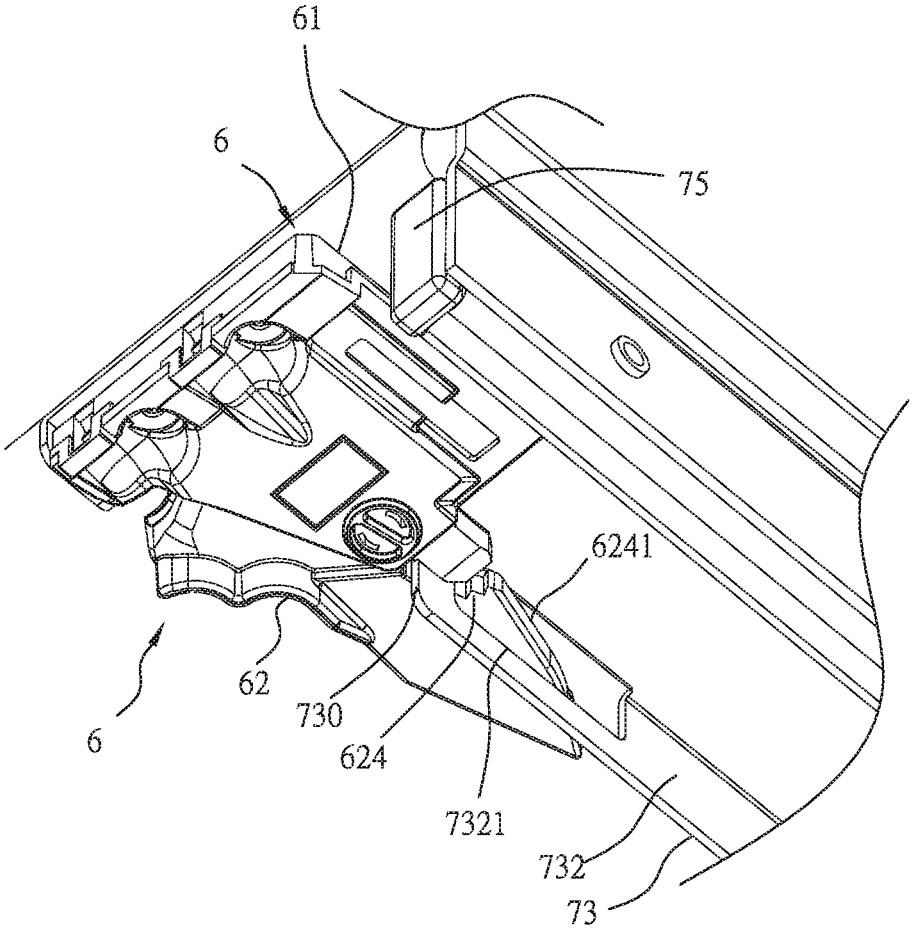
FIG. 9 is an enlarged view of a portion of FIG. 8.
Figure 10:
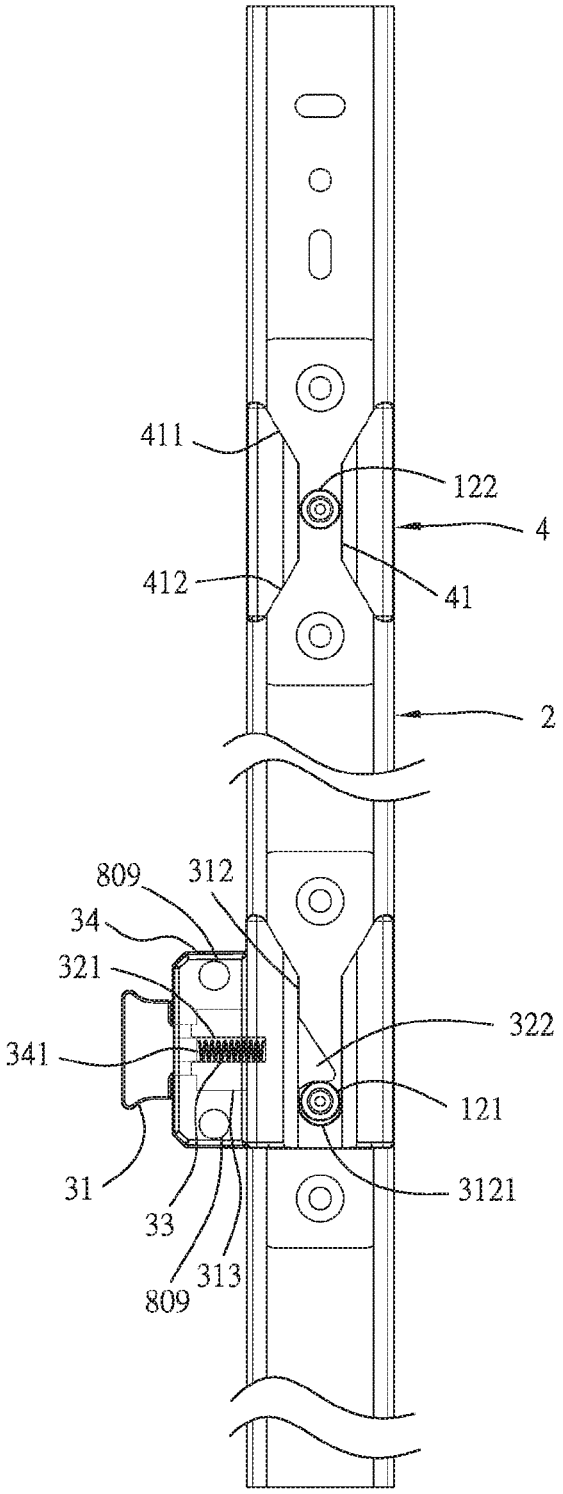
FIG. 10 is a top plan view illustrating the relationship between the front and rear positioning rods of the inner sliding rail of the upper sliding rail assembly relative to the front positioning block, the rear positioning block and the bracket.
Figure 11:
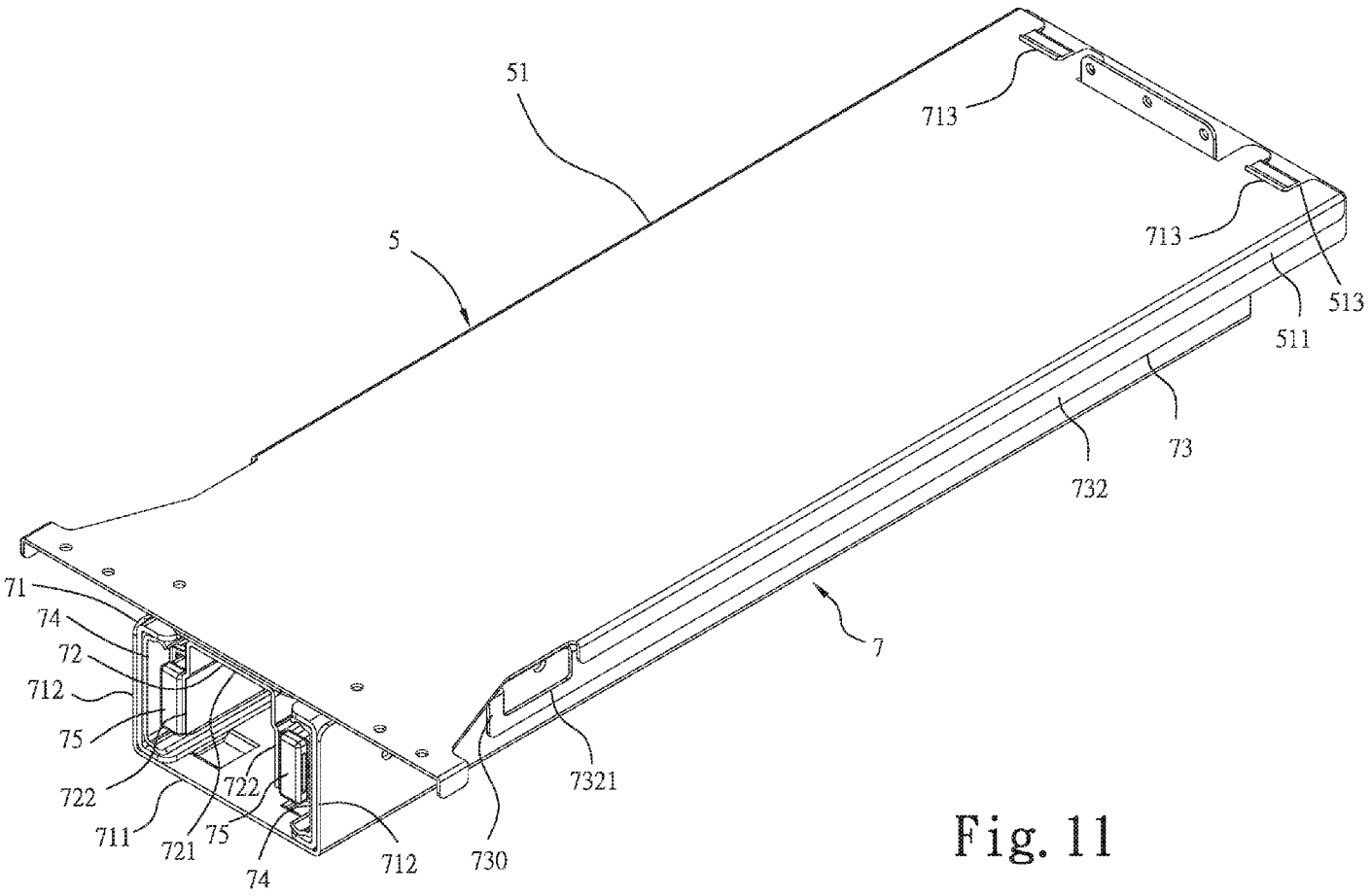
FIG. 11 is an upper perspective view illustrating the tray and the lower sliding rail assembly in an assembled condition.

The tall cabinet quick release structure further includes a tray 5, which includes a flat bearing surface 51, a plurality of through holes 510 vertically cut through the bearing surface 51 near a front side thereof (see FIGS. 1 and 3) and affixed to an opposing bottom surface 922 of the wooden cabinet 92 by fifth fastening members 805 (see FIG. 3). The tray 5 has an upright locating plate 511 with multiple through holes 5111 located at an opposing rear side of the bearing surface 51 (see FIGS. 1 and 3) and which is affixed to a bottom edge 923 of a rear of the wooden cabinet 92 by sixth fastening members 806 (see FIG. 3). The tray 5 includes two side flanges 512 respectively downwardly extended along opposing left and right sides of the bearing surface 51, at least one locating notch 513, shown in this example as two locating notches 513, each located at the rear side of the bearing surface 51 (see FIGS. 1, 3 and 11), and a plurality of through holes 514 symmetrically located at a front side relative to the side flanges 512 and affixed to the bottom surface 922 of the wooden cabinet 92 and to left and right latch devices 6 by seventh fastening members 807. The left and right latch devices 6 (see FIGS. 1, 3, 8, 9, 15 and 16) are respectively mounted at the two opposing left and right sides of the tray 5 and respectively fastenable to opposing left and right sides of a lower sliding rail assembly 7 (see FIGS. 8 and 9) or releasable from the lower sliding rail assembly 7 (see FIGS. 18 and 19).

The lower sliding rail assembly 7 is coupled with the tray 5 for allowing the tray 5 to slide back and forth thereon, and includes a sliding rail holder 71 (see FIGS. 1 and 11) affixed to an inner bottom surface 912 of the cabinet housing 91 by eighth fastening members 808 (see FIG. 2), an inner bracket 72 axially movable in and out of the sliding rail holder 71, and a bottom locating frame 73 affixed to a top side of the inner bracket 72 above the sliding rail holder 71 and movable with the inner bracket 72 back and forth relative to the sliding rail holder 71. The bottom locating frame 73 includes at least one stop plate 731, shown in this example as two stop plates 731, each located on a top surface near a rear end thereof (see FIGS. 1, 2 and 11) which engage into the locating notches 513 at the bearing surface 51 of the tray 5 (see FIGS. 1, 3 and 11) to stop the tray 5 from backward displacement, and two retaining grooves 7321 respectively located on two opposite sidewalls 732 thereof (see FIGS. 1, 2 and 11) for the engagement of the left and right latch devices 6 (see FIGS. 8 and 9) in a releasable manner (see FIGS. 18 and 19).

Further, the front positioning block 3 (see FIGS. 1, 7, 10, 13 and 14) includes a base 31 (see FIGS. 1, 7 and 14), a latch block 32, a spring 33 (see FIGS. 1, 10 and 14) and a cover 34. The base 31 comprises a plurality of through holes 311 fastened to the bracket 2 and the wooden cabinet 92 by the aforesaid third fastening members 803, an accommodation chamber 312 extended in a longitudinal direction (see FIGS. 7, 10 and 14), and a guide slot 313 extended in a transverse direction in communication with the accommodation chamber 312 (see FIGS. 7, 10 and 14) for guiding the latch block 32 in and out of the accommodation chamber 312. The latch block 32 comprises a spring positioning portion, for example, spring positioning groove 321 (see FIGS. 10 and 14) for receiving the spring 33, and a positioning end piece 322 located at a front end relative to the spring positioning groove 321. The cover 34 is affixed to the base 31 by ninth fastening members 809 (see FIGS. 7 and 10) and the cover 34 is bridged over the guide slot 313, having a stop rod 341 inserted into the guide slot 313 (see FIG. 14). The spring 33 is accommodated in the spring positioning groove 321 and stopped between an inner end edge of the spring positioning groove 321 and the stop rod 341 of the cover 34 (see FIGS. 10, 13 and 17) to impart a forward force to the latch block 32, keeping the positioning end piece 322 of the latch block 32 in the accommodation chamber 312 (see FIGS. 7, 10 and 13). Thus, the front positioning rod 121 of the inner sliding rail 12 of the upper sliding rail assembly 1 can be forced to push the positioning end piece 322 of the latch block 32 against the spring 33 (see FIG. 17) and to further move the latch block 32 out of the accommodation chamber 312 of the base 31 and to simultaneously compress the spring 33. When the front positioning rod 121 is moved away from the positioning end piece 322 of the latch block 32 to a front side 3121 of the accommodation chamber 312 (see FIG. 10), the latch block 32 is immediately pushed back by the elastic restoring energy of the spring 33 to move the positioning end piece 322 into the accommodation chamber 312, causing the positioning end piece 322 to lock the front positioning rod 121 to the bracket 2 (see FIG. 10). Further, when the latch block 32 is pulled out of the guide slot 313 by an external force, the front positioning rod 121 is unlocked and can be moved out of the accommodation chamber 312 of the base 31 (see FIG. 17).

The positioning end piece 322 of the latch block 32 of the front positioning block 3 has a beveled guide edge 3221 (see FIGS. 7, 13 and 14) for guiding the front positioning rod 121 of the inner sliding rail 12 of the upper sliding rail assembly 1 into engagement with the latch block 32.

The rear positioning block 4 has sloping guide surfaces 411, 412 respectively located on opposing front and rear sides of the position-limiting groove 41 (see FIGS. 1, 10 and 13) for guiding the rear positioning rod 122 of the upper sliding rail assembly 1 into the position-limiting groove 41 of the rear positioning block 4.

In this example, the left and right latch devices 6 are symmetrical (see FIGS. 1, 3, 8, 9, 15 and 16), each comprising a holder block 61 and a hook block 62. The holder block 61 includes a plurality of through holes 611 (see FIGS. 3, 15 and 16) and is affixed to the tray 5 and the bottom surface 922 of the wooden cabinet 92 by the aforesaid seventh fastening members 807. The pivot block 61 also includes a pivot post 612 (see FIGS. 15 and 16) pivotally coupled to the hook block 62, and further includes a locating groove 613. The hook block 62 comprises a pivot hole 621 coupled with the pivot post 612 of the holder block 61, an elastic arm 622 (see FIGS. 15 and 16) extended from one end thereof and terminating in a positioning tip 6221 that is positioned in the locating groove 613 of the holder block 61 (see FIGS. 15 and 16), and a hook 624 extended from an opposite end thereof (see FIGS. 8, 15 and 16) for hooking in one respective retaining groove 7321 at the bottom locating frame 73 of the lower sliding rail assembly 7 (see FIGS. 8 and 9). Further, the hook 624 of the hook block 62 has a sloping guide surface portion 6241 (see FIGS. 8, 9, 15 and 16) for guiding the hook 624 into engagement with the respective retaining groove 7321 at the bottom locating frame 73 of the lower sliding rail assembly 7.

Further, the sliding rail holder 71 of the lower sliding rail assembly 7 includes a bottom wall 711 (see FIGS. 1 and 11), and opposing left and right sidewalls 712 respectively extended along opposing left and right sides of the bottom wall 711. The bottom wall 711 is fastened to the inner bottom surface 912 of the cabinet housing 91 (see FIG. 2). The lower sliding rail assembly 7 further includes two fixed rails 74 respectively fixedly mounted at the left and right sidewall 712 of the sliding rail holder 71 to face toward each other, and two movable rails 75 respectively slidably coupled to the fixed rails 74 (see FIGS. 1 and 11). The inner bracket 72 of the lower sliding rail assembly 7 includes a top bracket panel 721, and two opposing side bracket panels 722 respectively downwardly extended from opposing left and right sides of the top bracket panel 721 and respectively affixed to the movable rails 75 (see FIGS. 1, 11 and 19). The top bracket panel 721 of the inner bracket 72 is affixed to the bottom locating frame 73 of the lower sliding rail assembly 7 (see FIG. 1) so that the inner bracket 72 can be moved with the movable rail 75 and the bottom locating frame 73 back and forth relative to the sliding rail holder 71.

When dismounting the wooden cabinet 9, a user pulls the wooden cabinet 9 outward from the cabinet housing 91 (see FIG. 5), and then pulls the latch block 32 of the front positioning block 3 backward to compress the spring 33 (see FIG. 17) and to move the positioning end piece 322 out of the accommodation chamber 312 of the base 31 and to further unlock the front positioning rod 121 of the inner sliding rail 12. The user then pushes the inner sliding rail 12 backwardly toward the cabinet housing 91 to move the front positioning rod 121 of the inner sliding rail 12 out of the accommodation chamber 312 of the base 31 and the rear positioning rod 122 of the inner sliding rail 12 out of the position-limiting groove 41 of the rear positioning block 4 (see FIG. 4). The user then presses the hook blocks 62 of the left and right latch devices 6 (see FIGS. 18 and 19) to disengage the hooks 624 from the respective retaining grooves 7321 of the bottom locating frame 73 of the lower sliding rail assembly 7, and then pulls the wooden cabinet 92 forwardly and completely out of the cabinet housing 91. Since the flat bearing surface 51 of the tray 5 is affixed to the bottom surface 922 of the wooden cabinet 92, the wooden cabinet 92 can be moved back and forth stably relative to the bottom locating frame 73 of the lower sliding rail assembly 7, while the left and right latch devices 6 are disengaged from the retaining grooves 7321 of the bottom locating frame 73 of the lower sliding rail assembly 7. Thus, the user can pull the wooden cabinet 92 forwardly out of the cabinet housing 91 with less effort. Further, when wishing to put the wooden cabinet 92 in the cabinet housing 91, the users pulls out the inner sliding rail 12 of the upper sliding rail assembly 1 and the bottom locating frame 73 of the lower sliding rail assembly 7 (see FIG. 2), and then puts the wooden cabinet 92 on the bottom locating frame 73 (see FIG. 4). The user then pushes the wooden cabinet 92 slowly into the inside of the cabinet housing 91 to force the position-limiting groove 41 of the rear positioning block 4 over the front positioning rod 121 of the inner sliding rail 12 to the rear positioning rod 122 of the inner sliding rail 12. At this time, the beveled guide edge 3221 of the positioning end piece 322 of the latch block 32 of the front positioning block 3 is forced by the front positioning rod 121 (see FIG. 17), causing the latch block 32 to compress the spring 33 and to move backwardly along the guide slot 313, and thus, the positioning end piece 322 of the latch block 32 is moved away from the front side 3121 of the accommodation chamber 312. After the front positioning rod 121 passes over the latch block 32, the elastic restoring energy of the spring 33 immediately pushes the latch block 32 back to its previous position, causing the positioning end piece 322 to lock the front positioning rod 121 (see FIGS. 6, 7 and 10). At this time, the rear positioning rod 122 of the inner sliding rail 12 is positioned in the position-limiting groove 41 of the rear positioning block 4. Further, when the sloping guide surface portions 6241 of the hooks 624 of the hook blocks 62 of the left and right latch devices 6 touch the left and right front edges 730 of the bottom locating frame 73 of the lower sliding rail assembly 7 (see FIGS. 1 and 9), the hook blocks 62 are biased and forced into engagement with the left and right retaining grooves 7321 of the bottom locating frame 73 (see FIG. 9). At this time, the locating notches 513 at the rear side of the bearing surface 51 of the tray 5 are forced into engagement with the respective stop plates 731 of the bottom locating frame 73 of the lower sliding rail assembly 7 (see FIGS. 1 and 11), and thus, the installation is complete.

In conclusion, the invention has advantages and features that distinguish over the prior art. The advantages include that when dismounting the wooden cabinet 92, a user pulls the latch block 32 of the front positioning block 3 outward (see FIG. 17) to move the front positioning rod 121 out of the front positioning block 3, and then pushes the inner sliding rail 12 backward to disengage the front positioning rod 121 from the accommodation chamber 312 of the front positioning block 3 and the rear positioning rod 122 from the position-limiting groove 41 of the rear positioning block 4. The user then presses the left and right latch devices 6 to disengage the respective hook blocks 62 from the left and right retaining grooves 7321 of the bottom locating frame 73 of the lower sliding rail assembly 7 (see FIGS. 18 and 19), and then pulls the wooden cabinet 92 out of the open-front cabinet housing 91.

Because the bearing surface 51 of the tray 5 that is affixed to the bottom surface 922 of the wooden cabinet 92 is a flat surface, the wooden cabinet 92 can be pulled out relative to the bottom locating frame 73 of the lower sliding rail assembly 7 smoothly, stably and with less effort.

Installation of the wooden cabinet 92 in the cabinet housing 91 enables the front positioning rod 121 of the upper sliding rail assembly 1 to be locked by the latch block 32 of the front positioning block 3 (see FIGS. 6, 7 and 10) and the rear positioning rod 122 of the upper sliding rail assembly 1 to be located by the position-limiting groove 41 of the rear positioning block 4, and at the same time, enables the hooks 624 of the hook blocks 62 of the left and right latch devices 6 to hook in the respective retaining grooves 7321 of the bottom locating frame 73 of the lower sliding rail assembly 7 (see FIGS. 8 and 9), thus simplifying the installation of the wooden cabinet 92 in the cabinet housing 91.

When putting the wooden cabinet 92 back into the cabinet housing 91, the bearing surface 51 of the tray 5 that is affixed to the bottom surface 92 of the wooden cabinet 92 (see FIGS. 1 and 11) can be moved relative to the bottom locating frame 73 of the lower sliding rail assembly 7 smoothly with less effort, enabling the locating notches 513 of the tray 5 to be forced into engagement with the stop plates 731 of the lower sliding rail assembly 7 (see FIGS. 1 and 11) to hold the wooden cabinet 92 positively in position.

Although a particular embodiment of the present invention has been described for purposes of illustration, various modifications and enhancements may be made without departing from the spirit and scope of the invention. Accordingly, the invention is not to be limited except as by the appended claims.

What is claimed is:

1. A tall cabinet quick release structure, comprising:

an upper sliding rail assembly comprising an outer sliding rail affixed to a bottom surface of a top panel of an open-front cabinet housing by first fastening members and an inner sliding rail coupled to and axially movable in and out of said outer sliding rail, said inner sliding rail comprising a front positioning rod and a rear positioning rod respectively downwardly extended from a bottom wall of said inner sliding rail;

a bracket affixed to a top surface of a wooden cabinet by second fastening members;

a front positioning block affixed to said bracket and to said top surface of said wooden cabinet by third fastening members and adapted for releasably securing said front positioning rod of said inner sliding rail of said upper sliding rail assembly;

a rear positioning block affixed to said bracket and to said top surface of said wooden cabinet by fourth fastening members, said rear positioning block comprising a position-limiting groove extended in the sliding direction of said inner sliding rail of said upper sliding rail assembly and adapted for allowing said front positioning rod of said inner sliding rail of said upper sliding rail assembly to pass therethrough and for releasably locating said rear positioning rod of said inner sliding rail;

a tray comprising a flat bearing surface, a plurality of through holes vertically cut through said bearing surface near a front side thereof and affixed to an opposing bottom surface of said wooden cabinet by fifth fastening members, an upright locating plate with multiple through holes located at an opposing rear side of said bearing surface and affixed to a bottom edge of a rear of said wooden cabinet by sixth fastening members, two side flanges respectively downwardly extended along opposing left and right sides of said bearing surface, at least one locating notch located at the said rear side of said bearing surface, and a plurality of through holes symmetrically located at a front side relative to said side flanges and affixed to said bottom surface of said wooden cabinet and to left and right latch devices by seventh fastening members;

said left and right latch devices respectively mounted at two opposing left and right sides of said tray and respectively fastenable to opposing left and right sides of a lower sliding rail assembly; and said lower sliding rail assembly coupled with said tray for allowing said tray to slide back and forth thereon, said lower sliding rail assembly comprising a sliding rail holder affixed to an inner bottom surface of said cabinet housing by eighth fastening member, an inner bracket axially movable in and out of said sliding rail holder and a bottom locating frame affixed to a top side of said inner bracket above said sliding rail holder and movable with said inner bracket back and forth relative to said sliding rail holder, said bottom locating frame comprising at least one stop plate located on a top surface near a rear end thereof which engages into said at least one locating notch at said bearing surface of said tray to stop said tray from backward displacement and two retaining grooves respectively located on two opposite sidewalls for engagement of said left and right latch devices.

2. The tall cabinet quick release structure as claimed in claim 1, wherein said front positioning block comprises a base, a latch block, a spring and a cover, said base comprising a plurality of through holes fastened to said bracket and said wooden cabinet by said third fastening members, an accommodation chamber extended in a longitudinal direction, a guide slot extended in a transverse direction in communication with said accommodation chamber for guiding said latch block in and out of said accommodation chamber, said latch block comprising a spring positioning groove for receiving said spring and a positioning end piece located at a front end relative to said spring positioning groove, said cover being affixed to said base by ninth fastening members and bridged over said guide slot, said cover comprising a stop rod inserted into said guide slot, said spring being accommodated in said spring positioning groove and stopped between an inner end edge of said spring positioning groove and said stop rod of said cover to impart a forward force to said latch block and to keep said positioning end piece of said latch block in said accommodation chamber so that said front positioning rod of said inner sliding rail of said upper sliding rail assembly is movable to push said positioning end piece of said latch block against said spring and to further move said latch block out of said accommodation chamber of said base and to simultaneously compress said spring; when said front positioning rod is moved away from said positioning end piece of said latch block to a front side of said accommodation chamber, said latch block is immediately pushed back by said spring to move said positioning end piece into said accommodation chamber, causing said positioning end piece to lock said front positioning rod; when said latch block is pulled out of said guide slot by an external force, said front positioning rod is unlocked and movable out of said accommodation chamber of said base.

3. The tall cabinet quick release structure as claimed in claim 2, wherein said positioning end piece of said latch block of said front positioning block comprises a beveled guide edge for guiding said front positioning rod of said inner sliding rail of said upper sliding rail assembly into engagement with said latch block.

4. The tall cabinet quick release structure as claimed in claim 1, wherein said rear positioning block comprises two sloping guide surfaces respectively located on opposing front and rear sides of said position-limiting groove for guiding said rear positioning rod of said upper sliding rail assembly into said position-limiting groove of said rear positioning block.

5. The tall cabinet quick release structure as claimed in claim 1, wherein said left and right latch devices are symmetrical, each comprising a holder block and a hook block, said holder block comprising a plurality of through holes affixed to said tray and to said bottom surface of said wooden cabinet by said seventh fastening members, a pivot post pivotally coupled to said hook block and a locating groove, said hook block comprising a pivot hole coupled with said pivot post of said holder block, an elastic arm extended from one end thereof and terminating in a positioning tip and a hook extended from an opposite end thereof for hooking in one respective retaining groove at said bottom locating frame of said lower sliding rail assembly, said positioning tip being positioned in said locating groove of said holder block, said hook of said hook block comprising a sloping guide surface portion for guiding said hook into engagement with the respective said retaining groove at said bottom locating frame of said lower sliding rail assembly.

6. The tall cabinet quick release structure as claimed in claim 1, wherein said sliding rail holder of said lower sliding rail assembly comprises a bottom wall and opposing left and right sidewalls respectively extended along opposing left and right sides of said bottom wall, said bottom wall of said sliding rail holder being fastened to said inner bottom surface of said cabinet housing; said lower sliding rail assembly further comprises two fixed rails respectively fixedly mounted at the left and right sidewall of said sliding rail holder to face toward each other and two movable rails respectively slidably coupled to said fixed rails; said inner bracket of said lower sliding rail assembly comprises a top bracket panel and two opposing side bracket panels respectively downwardly extended from opposing left and right sides of said top bracket panel and respectively affixed to said movable rails, said top bracket panel of said inner bracket being affixed to said bottom locating frame of said lower sliding rail assembly so that said inner bracket is movable with said movable rail and said bottom locating frame back and forth relative to said sliding rail holder.

7. A tall cabinet quick release structure, comprising:

an upper sliding rail assembly comprising an outer sliding rail connected to a bottom surface of a top panel of a cabinet housing having a front opening, and an inner sliding rail coupled to and axially movable in and out of said outer sliding rail, said inner sliding rail comprising a front positioning rod and a rear positioning rod respectively downwardly extended from a bottom wall of said inner sliding rail;

a bracket connected to a top surface of a wooden cabinet;

a front positioning block connected to said bracket and adapted for releasably securing said front positioning rod;

a rear positioning block connected to said bracket, said rear positioning block comprising a position-limiting groove extended in the sliding direction of said inner sliding rail and adapted for passage of said front positioning rod therethrough and for locating said rear positioning rod;

a tray comprising a flat bearing surface connected to an opposing bottom surface of said wooden cabinet, an upright locating plate at a rear of said bearing surface connected to a rear of said wooden cabinet, two side flanges respectively downwardly extended along opposing left and right sides of said bearing surface, at least one locating notch located at said rear of said bearing surface, and being connected to said bottom surface of said wooden cabinet;

left and right latch devices respectively mounted at two opposing left and right sides of said tray and respectively releasably connected to opposing left and right sides of a lower sliding rail assembly; and the lower sliding rail assembly coupled with said tray for allowing said tray to slide back and forth thereon, said lower sliding rail assembly comprising a sliding rail holder connected to an inner bottom surface of said cabinet housing, an inner bracket axially movable in and out of said sliding rail holder and a bottom locating frame connected to a top side of said inner bracket above said sliding rail holder and movable with said inner bracket back and forth relative to said sliding rail holder, said bottom locating frame comprising at least one stop plate located on a top surface near a rear end thereof which engages into said at least one locating notch at the rear of said bearing surface of said tray, and two retaining grooves respectively located on two opposite sidewalls for engagement of said left and right latch devices.

8. The tall cabinet quick release structure as claimed in claim 7, wherein said front positioning block comprises a base, a latch block, a spring and a cover, said base comprising an accommodation chamber extended in a longitudinal direction, a guide slot extended in a transverse direction in communication with said accommodation chamber for guiding said latch block in and out of said accommodation chamber.

9. The tall cabinet quick release structure as claimed in claim 8, wherein, said latch block comprises a spring positioning groove for receiving said spring and a positioning end piece located at a front end relative to said spring positioning groove, said cover bridging over said guide slot and further comprising a stop rod extending into said guide slot, said spring being accommodated in said spring positioning groove and stopped between an inner end edge of said spring positioning groove and said stop rod of said cover to impart a forward force to said latch block and to keep said positioning end piece of said latch block in said accommodation chamber.

10. The tall cabinet quick release structure as claimed in claim 9, wherein said front positioning rod of said inner sliding rail of said upper sliding rail assembly is movable to push said positioning end piece of said latch block against said spring and to further move said latch block out of said accommodation chamber of said base and to simultaneously compress said spring, and wherein when said front positioning rod is moved away from said positioning end piece of said latch block to a front side of said accommodation chamber, said latch block is immediately pushed back by said spring to move said positioning end piece into said accommodation chamber, causing said positioning end piece to lock said front positioning rod.

11. The tall cabinet quick release structure as claimed in claim 10, wherein when said latch block is pulled out of said guide slot by an external force, said front positioning rod is unlocked and movable out of said accommodation chamber of said base.

12. The tall cabinet quick release structure as claimed in claim 9, wherein said positioning end piece of said latch block of said front positioning block comprises a beveled guide edge for guiding said front positioning rod of said inner sliding rail of said upper sliding rail assembly into engagement with said latch block.

13. The tall cabinet quick release structure as claimed in claim 7, wherein said rear positioning block comprises two sloping guide surfaces respectively located on opposing front and rear sides of said position-limiting groove for guiding said rear positioning rod of said upper sliding rail assembly into said position-limiting groove of said rear positioning block.

14. The tall cabinet quick release structure as claimed in claim 1, wherein each of said left and right latch devices further comprises a holder block and a hook block, and said holder block connected to said tray.

15. The tall cabinet quick release structure as claimed in claim 14, wherein each of said left and right latch devices further comprises a pivot post pivotally coupled to said hook block and a locating groove, said hook block comprising a pivot hole coupled with said pivot post of said holder block.

16. The tall cabinet quick release structure as claimed in claim 15, wherein each said hook block further comprises an elastic arm extended from one end of said hook block and terminating in a positioning tip and a hook extended from an opposite end thereof.

17. The tall cabinet quick release structure as claimed in claim 16, wherein said positioning tip and hook of each said hook block engages one respective retaining groove at said bottom locating frame of said lower sliding rail assembly, with said positioning tip being positioned in said locating groove of said holder block, said hook of said hook block further comprising a sloping guide surface portion for guiding said hook into engagement with the respective said retaining groove at said bottom locating frame of said lower sliding rail assembly.

18. The tall cabinet quick release structure as claimed in claim 1, wherein said sliding rail holder of said lower sliding rail assembly comprises a bottom wall and opposing left and right sidewalls respectively extended along opposing left and right sides of said bottom wall, said bottom wall of said sliding rail holder being fastened to said inner bottom surface of said cabinet housing.

19. The tall cabinet quick release structure as claimed in claim 18, wherein said lower sliding rail assembly further comprises two fixed rails respectively fixedly mounted at the left and right sidewall of said sliding rail holder to face toward each other and two movable rails respectively slidably coupled to said fixed rails.

20. The tall cabinet quick release structure as claimed in claim 19, wherein said inner bracket of said lower sliding rail assembly comprises a top bracket panel and two opposing side bracket panels respectively downwardly extended from opposing left and right sides of said top bracket panel and respectively connected to said movable rails, said top bracket panel of said inner bracket being connected to said bottom locating frame of said lower sliding rail assembly, and said inner bracket being movable with said movable rail and said bottom locating frame back and forth relative to said sliding rail holder.

* * * * *